US006076202A

United States Patent [19]

Lockwood

[11] Patent Number: 6,076,202

[45] Date of Patent: Jun. 20, 2000

[54] SHAMPOO SINK SYSTEM

[76] Inventor: M. Olene Lockwood, 5519 Nettie Rd., Jacksonville, Fla. 32207

[21] Appl. No.: 09/352,831

[22] Filed: Jul. 13, 1999

[51] Int. Cl.[7] ..... A45D 19/08; A45D 19/10

[52] U.S. Cl. ..... 4/519; 4/515; 4/516; 4/522; 4/619; 4/657

[58] Field of Search ..... 4/515, 516, 517, 4/519, 520, 522, 523, 619, 657, DIG. 18

[56] References Cited

U.S. PATENT DOCUMENTS

| | | | |
|---|---|---|---|
| 2,167,572 | 7/1939 | Howe | 4/522 |
| 2,954,077 | 9/1960 | Wanner | 4/522 |
| 3,731,325 | 5/1973 | Guarrasi | 4/159 |
| 4,587,680 | 5/1986 | Brugger | 4/519 |
| 4,649,580 | 3/1987 | Bastien | 4/523 |
| 4,821,347 | 4/1989 | Nash | 4/516 |
| 5,007,118 | 4/1991 | Ebersole | 4/515 |
| 5,144,701 | 9/1992 | Clark | 4/515 |

*Primary Examiner*—David J. Walczak
*Assistant Examiner*—Tuan Nguyen
*Attorney, Agent, or Firm*—Joseph N. Breaux

[57] ABSTRACT

A shampoo sink system that includes an adjustable base assembly including an anti-tip wall attachment structure that includes an exterior sink structure having a liner structure with an emptying trough hingedly attached thereto. The liner structure is emptied by pivoting the liner at the hinge.

1 Claim, 3 Drawing Sheets

SHAMPOO SINK SYSTEM

TECHNICAL FIELD

The present invention relates to portable sink shampoo sink assemblies and more particularly to a shampoo sink system that includes a telescoping support assembly including a base structure including a vertical tubular member, an exterior sink support assembly having a first end of a sink support pole slidingly mounted within the vertical tubular member and lockable with respect to the vertical tubular member in a number of fixed positions with a locking pin assembly and a second end with a lockable ball joint connector, and a telescoping sidewall brace structure extending perpendicularly outward from the sink support pole and terminating at a far end thereof in a suction cup wall attachment structure; an exterior sink structure including an exterior bottom sink surface in connection with the lockable ball joint connector of the exterior sink support assembly, a sink depression defined therein by exterior sink sidewalls, a neck receiving depression formed into one of the exterior sink sidewalls, and a hinge fastening structure on a exterior sink sidewall opposite the neck receiving depression; and a liner structure sized and shaped to fit into the sink depression of the exterior sink structure and that defines a shampooing basin therein; the liner structure including a liner depression formed into a liner sidewall thereof having an anti-drip lip extending outwardly therefrom, an extended emptying trough with raised side edges formed opposite the anti-drip lip, and a mating hinge fastening structure pivotally securable to the hinge fastening structure of the exterior sink structure with a removable hinge pin; the liner structure being pivotable about the installed hinge pin into a down position such that the anti-drip lip is positioned within and extends past the neck receiving depression of the exterior sink structure when the liner structure is pivoted into a down position and pivotable into an up position causing the contents of the shampooing basin to be emptied through the emptying trough.

BACKGROUND ART

It is difficult for many individuals because of disabilities and the like to have their hair shampooed at a conventional shampoo sink. It would be a benefit to theses individuals to have a shampoo sink system that was portable, that could be adapted to a number of heights, that included an anti-tip stabilizing structure and that was easily emptied after use by pivoting an inner liner positioned within an exterior sink structure.

GENERAL SUMMARY DISCUSSION OF INVENTION

It is thus an object of the invention to provide a shampoo sink system that includes a telescoping support assembly including a base structure including a vertical tubular member, an exterior sink support assembly having a first end of a sink support pole slidingly mounted within the vertical tubular member and lockable with respect to the vertical tubular member in a number of fixed positions with a locking pin assembly and a second end with a lockable ball joint connector, and a telescoping sidewall brace structure extending perpendicularly outward from the sink support pole and terminating at a far end thereof in a suction cup wall attachment structure; an exterior sink structure including an exterior bottom sink surface in connection with the lockable ball joint connector of the exterior sink support assembly, a sink depression defined therein by exterior sink sidewalls, a neck receiving depression formed into one of the exterior sink sidewalls, and a hinge fastening structure on a exterior sink sidewall opposite the neck receiving depression; and a liner structure sized and shaped to fit into the sink depression of the exterior sink structure and that defines a shampooing basin therein; the liner structure including a liner depression formed into a liner sidewall thereof having an anti-drip lip extending outwardly therefrom, an extended emptying trough with raised side edges formed opposite the anti-drip lip, and a mating hinge fastening structure pivotally securable to the hinge fastening structure of the exterior sink structure with a removable hinge pin; the liner structure being pivotable about the installed hinge pin into a down position such that the anti-drip lip is positioned within and extends past the neck receiving depression of the exterior sink structure when the liner structure is pivoted into a down position and pivotable into an up position causing the contents of the shampooing basin to be emptied through the emptying trough.

Accordingly, a shampoo sink system is provided. The shampoo sink system includes a telescoping support assembly including a base structure including a vertical tubular member, an exterior sink support assembly having a first end of a sink support pole slidingly mounted within the vertical tubular member and lockable with respect to the vertical tubular member in a number of fixed positions with a locking pin assembly and a second end with a lockable ball joint connector, and a telescoping sidewall brace structure extending perpendicularly outward from the sink support pole and terminating at a far end thereof in a suction cup wall attachment structure; an exterior sink structure including an exterior bottom sink surface in connection with the lockable ball joint connector of the exterior sink support assembly, a sink depression defined therein by exterior sink sidewalls, a neck receiving depression formed into one of the exterior sink sidewalls, and a hinge fastening structure on a exterior sink sidewall opposite the neck receiving depression; and a liner structure sized and shaped to fit into the sink depression of the exterior sink structure and that defines a shampooing basin therein; the liner structure including a liner depression formed into a liner sidewall thereof having an anti-drip lip extending outwardly therefrom, an extended emptying trough with raised side edges formed opposite the anti-drip lip, and a mating hinge fastening structure pivotally securable to the hinge fastening structure of the exterior sink structure with a removable hinge pin; the liner structure being pivotable about the installed hinge pin into a down position such that the anti-drip lip is positioned within and extends past the neck receiving depression of the exterior sink structure when the liner structure is pivoted into a down position and pivotable into an up position causing the contents of the shampooing basin to be emptied through the emptying trough.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
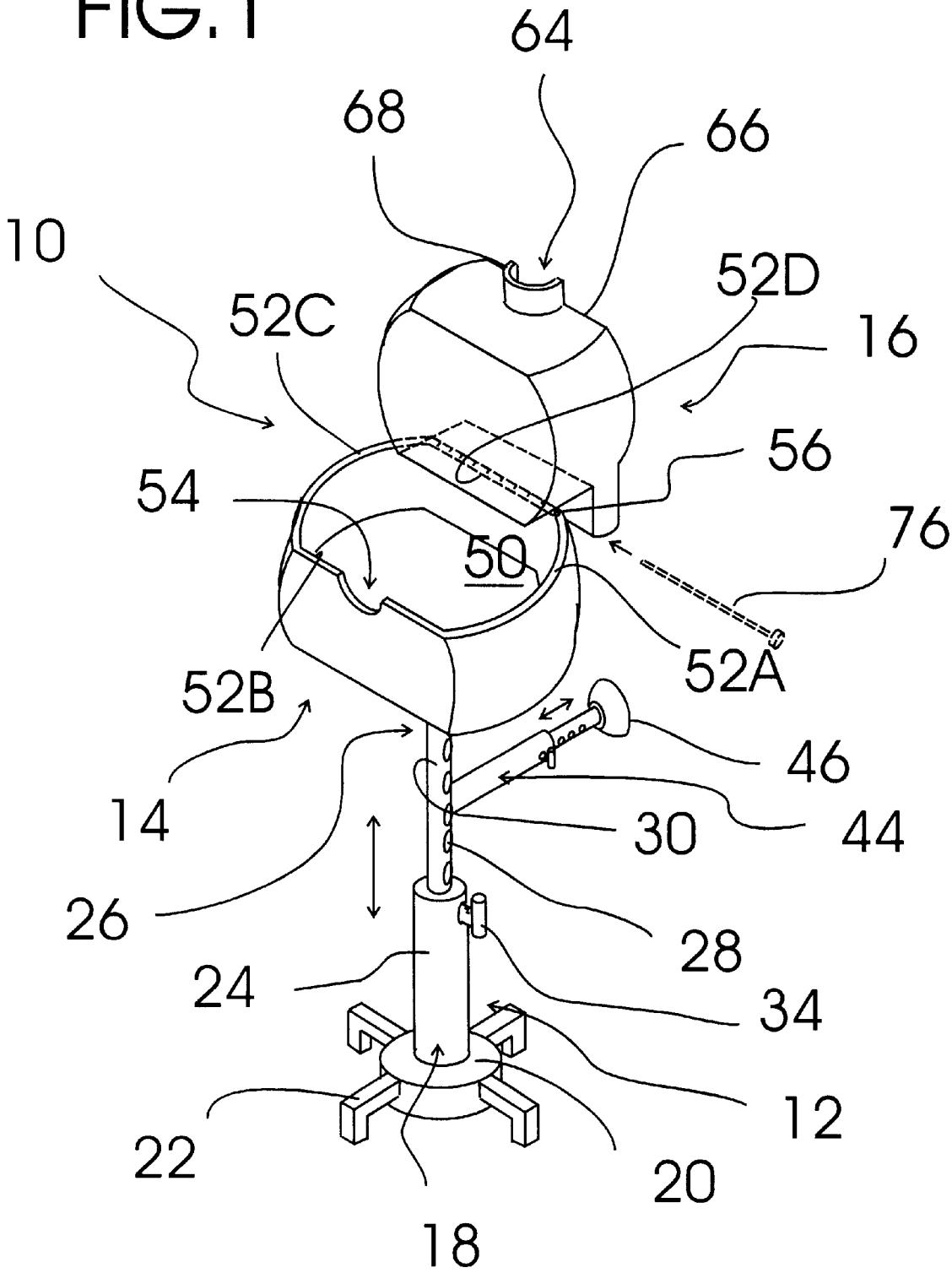
FIG. 1 is a perspective view of an exemplary embodiment of the shampoo sink system of the present invention.

FIG. 1 shows an exemplary embodiment of the shampoo sink system of the present invention generally designated 10. Shampoo sink system 10 includes a telescoping support assembly, generally designated 12; an exterior sink structure, generally designated 14 and a liner structure, generally designated 16.

Figure 3:
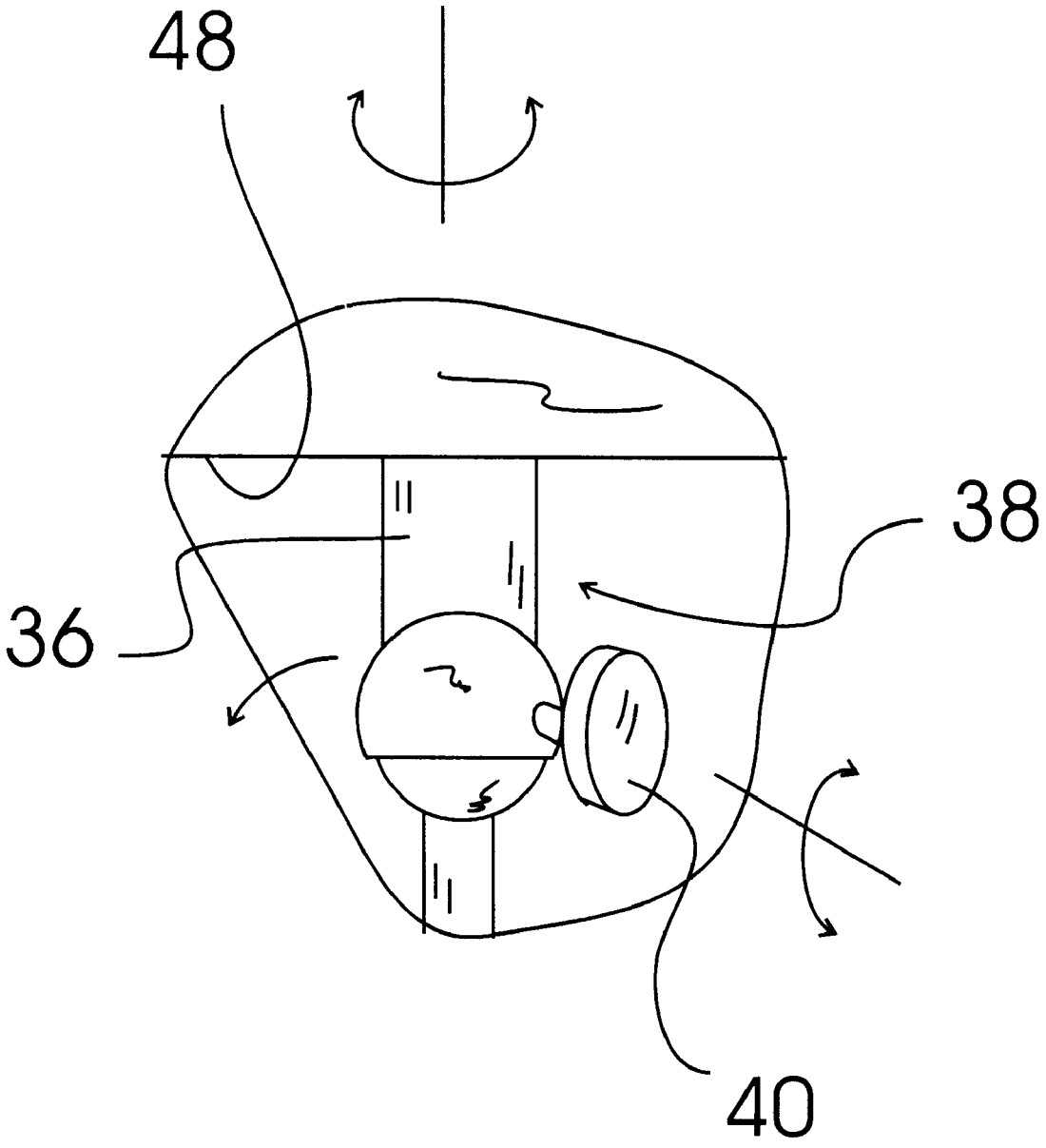
FIG. 3 is a detail plan view showing the exterior bottom sink surface in connection with the lockable ball joint connector of the exterior sink support assembly.

Telescoping support assembly 12 includes a base structure, generally designated 18 having a base plate 20 with four legs 22 extending from the side thereof and a vertical tubular member 24 extending upward from the center thereof; an exterior sink support assembly, generally designated 26, having a first end 28 of a sink support pole 30 slidingly mounted within vertical tubular member 24 and lockable with respect thereto with a locking pin assembly 34 and, (referring to FIG. 3) a second end 36 with a lockable ball joint connector, generally designated 38 including a position and orientation locking screw 40, and (referring back to FIG. 1) a telescoping sidewall brace structure, generally designated 44, extending perpendicularly outward from sink support pole 30 and terminating at a far end thereof in a suction cup attachment structure 46. Suction cup attachment structure is typically used to form a rigid anti-tip connection with the sidewall of a conventional shampoo sink.

Exterior sink structure 14 is of rigid molded plastic construction and includes an exterior bottom sink surface 48 (FIG. 3) in connection with lockable ball joint connector 38 (FIG. 3) of exterior sink support assembly 26, a sink depression 50 defined therein by exterior sink sidewalls 52*a–d,* a neck receiving depression 54 formed into exterior sink sidewall 52*b*, and a hinge fastening structure 56 on exterior sink sidewall 52*d* opposite neck receiving depression 54.

Figure 2:
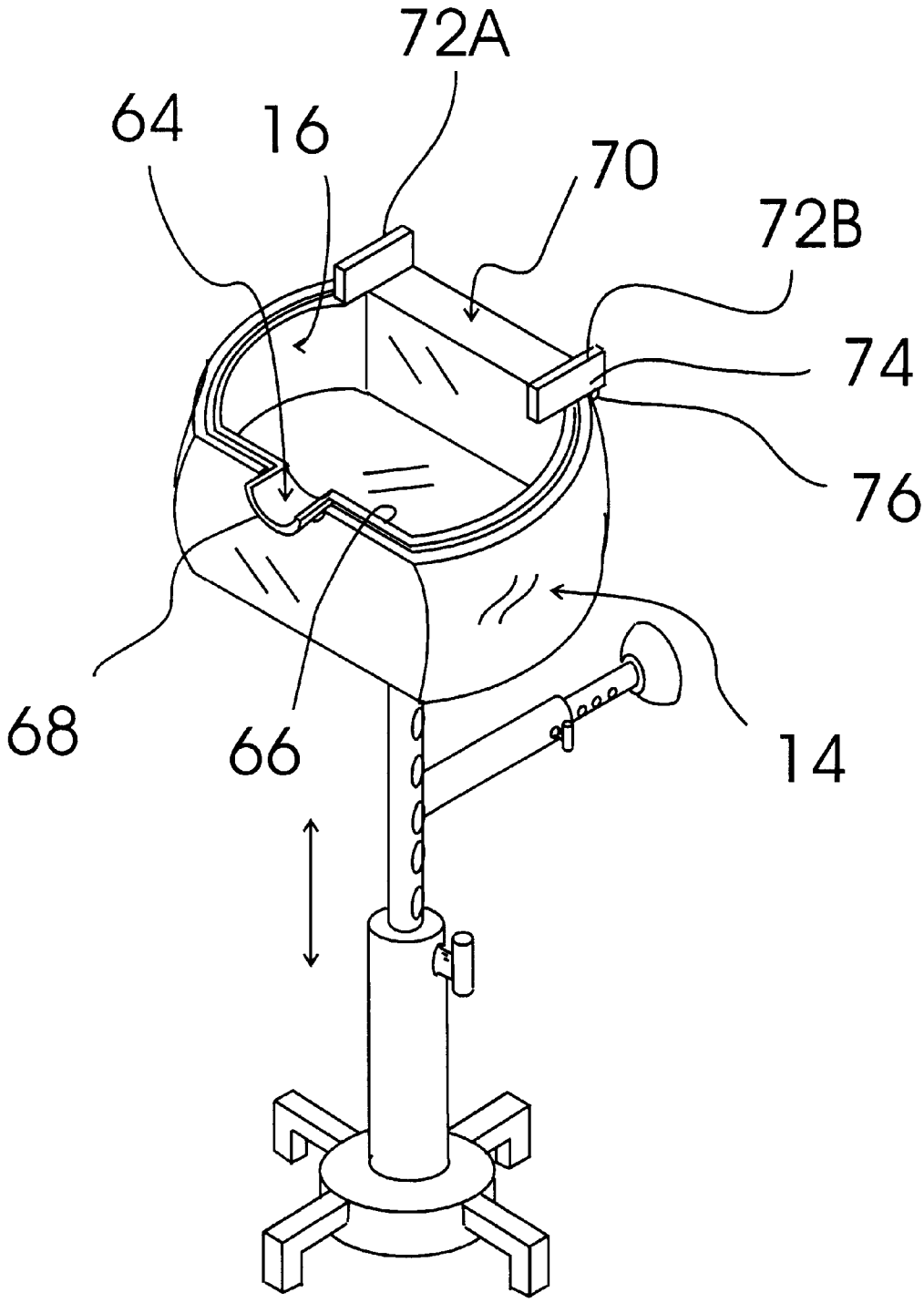
FIG. 2 is a perspective view showing the liner structure pivoted into the down position.

Referring to FIG. 2, liner structure 16 is of rigid molded plastic that is sized and shaped to fit into sink depression 50 (FIG. 1) of exterior sink structure 14 and has a shampooing basin 60 defined therein. Liner structure includes a liner depression formed 64 into a liner sidewall 66 thereof having an anti-drip lip 68 extending outwardly therefrom, an extended emptying trough 70 with raised side edges 72*a*,72*b* formed opposite anti-drip lip 68, and a mating hinge fastening structure 74 pivotally securable to the hinge fastening structure 56 (FIG. 1) of exterior sink structure 14 with a removable hinge pin 76 (shown in dashed lines in FIG. 1).

It can be seen from the preceding description that a shampoo sink system has been provided that includes a telescoping support assembly including a base structure including a vertical tubular member, an exterior sink support assembly having a first end of a sink support pole slidingly mounted within the vertical tubular member and lockable with respect to the vertical tubular member in a number of fixed positions with a locking pin assembly and a second end with a lockable ball joint connector, and a telescoping sidewall brace structure extending perpendicularly outward from the sink support pole and terminating at a far end thereof in a suction cup wall attachment structure; an exterior sink structure including an exterior bottom sink surface in connection with the lockable ball joint connector of the exterior sink support assembly, a sink depression defined therein by exterior sink sidewalls, a neck receiving depression formed into one of the exterior sink sidewalls, and a hinge fastening structure on a exterior sink sidewall opposite the neck receiving depression; and a liner structure sized and shaped to fit into the sink depression of the exterior sink structure and that defines a shampooing basin therein; the liner structure including a liner depression formed into a liner sidewall thereof having an anti-drip lip extending outwardly therefrom, an extended emptying trough with raised side edges formed opposite the anti-drip lip, and a mating hinge fastening structure pivotally securable to the hinge fastening structure of the exterior sink structure with a removable hinge pin; the liner structure being pivotable about the installed hinge pin into a down position such that the anti-drip lip is positioned within and extends past the neck receiving depression of the exterior sink structure when the liner structure is pivoted into a down position and pivotable into an up position causing the contents of the shampooing basin to be emptied through the emptying trough.

It is noted that the embodiment of the shampoo sink system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A shampoo sink system comprising:

a telescoping support assembly including a base structure including a vertical tubular member, an exterior sink support assembly having a first end of a sink support pole slidingly mounted within said vertical tubular member and lockable with respect to said vertical tubular member in a number of fixed positions with a locking pin assembly and a second end with a lockable ball joint connector, and a telescoping sidewall brace structure extending perpendicularly outward from said sink support pole and terminating at a far end thereof in a suction cup wall attachment structure;

an exterior sink structure including an exterior bottom sink surface in connection with said lockable ball joint connector of said exterior sink support assembly, a sink depression defined therein by exterior sink sidewalls, a neck receiving depression formed into one of said exterior sink sidewalls, and a hinge fastening structure on a exterior sink sidewall opposite said neck receiving depression; and a liner structure sized and shaped to fit into said sink depression of said exterior sink structure and that defines a shampooing basin therein;

said liner structure including a liner depression formed into a liner sidewall thereof having an anti-drip lip extending outwardly therefrom, an extended emptying trough with raised side edges formed opposite said anti-drip lip, and a mating hinge fastening structure pivotally securable to said hinge fastening structure of said exterior sink structure with a removable hinge pin;

said liner structure being pivotable about said installed hinge pin into a down position such that said anti-drip lip is positioned within and extends past said neck receiving depression of said exterior sink structure when said liner structure is pivoted into a down position and pivotable into an up position causing said contents of said shampooing basin to be emptied through said emptying trough.

* * * * *